United States Patent [19]

Brummer et al.

[11] 4,351,346

[45] Sep. 28, 1982

[54] PROCESS FOR THE PREPARATION OF AROMATIC SUBSTANCES

[75] Inventors: Ursula Brummer, Halstenbek; Volker Heeman, Reinbek, both of Fed. Rep. of Germany

[73] Assignee: B.A.T. Cigaretten-Fabriken GmbH, Hamburg, Fed. Rep. of Germany

[21] Appl. No.: 240,853

[22] Filed: Mar. 5, 1981

[30] Foreign Application Priority Data

Mar. 8, 1980 [DE] Fed. Rep. of Germany ..... 3009031

[51] Int. Cl.[3] ..... A24B 3/12; A24B 15/22; A24B 15/24; A24B 15/28

[52] U.S. Cl. ..... 131/276; 131/297; 131/298; 131/299; 204/158 R; 426/248

[58] Field of Search ..... 131/356, 276, 275, 274, 131/277–279, 297, 298, 309; 426/248; 204/158

[56] References Cited

U.S. PATENT DOCUMENTS

| | | | |
|---|---|---|---|
| 3,673,066 | 6/1972 | Muller | 204/158 R |
| 3,687,693 | 8/1972 | Essiet | 426/248 |
| 3,932,515 | 1/1976 | Shaffer et al. | 204/158 R |

FOREIGN PATENT DOCUMENTS

| | | | |
|---|---|---|---|
| 857624 | 7/1949 | Fed. Rep. of Germany | 131/299 |
| 2314775 | 6/1972 | Fed. Rep. of Germany | 131/299 |
| 2918920 | 1/1980 | Fed. Rep. of Germany | 131/275 |
| 1206210 | 2/1960 | France . | |
| 638327 | 6/1950 | United Kingdom | 131/300 |
| 1316172 | 3/1970 | United Kingdom . | |
| 1489762 | 10/1977 | United Kingdom | 131/297 |

OTHER PUBLICATIONS

Acidic Aroma Constituents of Turkish Tobacco, 41, Agric. Bioc. Chem., 1021 (1927).

Tobacco Chemistry, 43, Sensitized Photo—Oxygenation of (12Z)—Abienol Biomimetic Synthesis of Tobacco, Labdanoids Acta Chemica Scandinavica, B32 (1978).

Tobacco Chemistry, 48, Synthesis of Tobacco Labdanoids by Sensitized Photo oxygenation of (12E)—Abienol, Acta Chemica Scandinavica, B33 (1979).

Agric. Biol. Chem., 44(3), 705–706, 1980.

*Primary Examiner*—V. Millin

*Attorney, Agent, or Firm*—Arnold, White & Durkee

[57] ABSTRACT

Aromatic substances to be applied to tobacco to improve aroma characteristics are prepared by exposing an alcoholic extract, which contains carotenoids and may additionally contain diterpenes and has been isolated from fresh tobacco plants, to ultraviolet light and oxygen. Additionally, aromatic substances may be produced from xanthophyll containing plant extracts by the same method.

20 Claims, No Drawings

PROCESS FOR THE PREPARATION OF AROMATIC SUBSTANCES

BACKGROUND OF THE INVENTION

This invention relates to a process for the preparation of aromatic substances which can be employed as aromatizing additives for tobacco.

It is known that fresh tobacco plants contain diverse natural substances which, as smoke aroma precursors, influence the tobacco aroma. Thus, the surface resin of fresh tobacco plants, obtained by brief "washing" of the plants, contains the diterpenes, especially duvanes, which are valuable as precursors. The procedure for separating off these diterpenes has been disclosed in German Offenlegungsschrift No. 2,918,920. The diterpene fractions obtained by this procedure can, after isolation and purification, be added to conditioned tobacco (tobacco which has been processed ready for use).

Carotenoids which are also aroma precursors, also occur in the tobacco plants themselves. The isolation of these carotenoids in the form of alcoholic extracts is also known.

SUMMARY OF THE INVENTION

The method of the present invention allows the preparation of aromatic substances from a cartenoid containing alcoholic extract from which chlorophyll and also optionally the waxy diterpene components from the surface of the tobacco plant have been removed. This extract is prepared from green tobacco plants or parts thereof and then photo-oxidized in an alcoholic solution by exposure to oxygen and ultraviolet light. The process of the present invention also allows the preparation of aromatic substances by the photo-oxidation of an xanthophyll containing plant extract.

DESCRIPTION OF THE PREFERRED EMBODIMENT it has now been found that these carotenoids can be modified by suiable measures, so that aroma precusors and aromatic substances can be obtained which influence the smoke flavor of the tobacco in a particularly advantageous manner.

According to the invention, this is achieved when an alcoholic extract which contains cartenoids and is in itself known and from which chlorophyll and also, optionally, the waxy diterpene components pesent on the surface of the tobacco plant have been removed, is prepared from green tobacco plants or parts theeof, and this extract and/or other xanthophyll containing plant extracts are oxidized in an alcoholic solution with oxygen, under irradiation with ultraviolet (UV) light.

Starting material which can be used for the process of the invention is, in particular, green tobacco plants, the surface resin of which has been removed, for example by washing with methylene chloride. However, it is also possible to use plants which still contain the surface resin since, under certain circumstances, the diterpenes contained in the surface resin can also be converted to valuable aroma precursors or aromatic substances during the treatment according to the invention. Furthermore, xanthophyll rich extracts of other plants can also be employed, for example commercially available xanthophyll, which usually is obtainable commercially in paste form.

According to the process of the invention, the irradiation is preferably carried out at a wavelength 220–580 nm.

The irradiation is usually carried out at room temperature; however, other temperatures are also possible, for example temperatures between −20° C. and the boiling point of the solvent used.

The duration of the irradiation depends on the size of the batch for irradiation, on the particular type of carotenoids, which can vary depending on the tobacco plants, and on the power of the UV source. The irradiation time is generally one hour to ten days and in particular 6–24 hours.

According to a further advantageous embodiment of the process of the invention, the irradiation is carried out in the presence of sensitizers. It is true that diterpene fractions isolated from the surface resin have already been irradiated in the presence of oxygen and sensitizers, that is to say with a singlet oxygen, in order to clarify the chemical structure (compare Acta Chemica Scandinavica 1979, pp. 437–442), but it could not be expected that aroma precursors and aromatic substances with particularly advantageous properties can be obtained by a corresponding treatment of carotenoids.

All of the sensitizers which are suitable and customary in photo chemistry, especially Rose Bengal, can be used for carrying out the process. The oxidation involves absorption of UV light by the sensitizer which undergoes an electronic transition to the excited singlet state. Singlet oxygen then reacts with the carotenoids to give the oxidized product.

However, particular advantageous aroma precursors and aromatic substances are obtained when irradiation is carried out in the absence of the above-mentioned sensitizers. The photo-oxidation then no longer takes place by means of singlet oxygen, but rather by a conventional free radical mechanism. Accordingly, the aromatic substances obtained according to the invention contain products which have numerous carboxyl and carbonyl groups in a constitution which in other respects is unknown, inter alia, ketocarboxylic acids and also (usually in the lactone form) hydroxy carboxylic acids. The improvement in the properties of the aroma precursors and the aromatic substances which is achieved according to this process variant is surprising, since a considerably more extensive destruction of the aromatic substances would have been expected under these process conditions.

Starting materials which can be used for isolation of the above-mentioned carotenoids are, in particular, Nicotinia species, such as *N. tomentosiformis, glutinosa* or *sylvestris,* or known tobacco hybrids, and also tobacco plants from conventional tobacco crops. In particular, it is also possible to use those species of tobacco which of themselves are unsuitable as smoking tobacco.

Solvents which can be employed for the carotenoid fraction to be irradiated are lower alcohols, especially methanol and ethanol. The irradiated extracts can, optionally after prior concentration be applied direct, for example by spraying, to tobacco which has been processed ready for use.

It has, however proved particular advantageous if the irradiated extracts are fractionated prior to application to the tobacco. The purpose of this fractionation is to separate off undesired products with a low boiling point and also polymeric products which have an adverse influence on the tobacco aroma or can contribute nothing to its improvement. Diverse processes can be used for the fractionation.

An initial possibility for fractionation is column chromatography, for example on silica gel. With this method the irradiated extract is concentrated and the concentrated solution is introduced into a silica gel column. Elution is then carried out with various solvents of increasing polarity. For example, hexane can be employed as the first eluent; the eluent contains hydrocarbons, which can be discarded. Elution with ether is then carried out; this fraction contains, in the main, valuable lactones, obtained from the hydroxy carboxylic acids formed on photo-oxidation of the carotenoids, and also ketones and aldehydes. Finally, valuable carboxylic acids, in particular ketocarboxylic acids, can also be isolated with polar solvents, for example methanol to which 1% of cetic acid has been added. Polymers and also, in some cases highly polar compounds remain in the column.

A further suitable refractionation method is distillation. Even distilling off the methanol from the irradiated extract at room temperature in vacuo results in a removal of undesired, readily volatile constituents. This distillation can be followed by a distillation under a high vacuum, in which case the fractions which, under 0.02 mm Hg, pass over at temperatures of up to 100° C. are preferably collected.

Another suitable fractionation method is steam distillation. The constituents which volatilize with steam are collected.

The process of the invention is preferably carried out by passing a stream of air or oxygen through the extract and, at the same time, irradiating the extract using a source of UV light which supplies a wavelength of 220–580 nm. Conventional UV lamps, for example high pressure mercury lamps or the like, are suitable for the irradiation. In the text which follows, the process of the invention is illustrated in more detail with the aid of preferred illustrative examples.

EXAMPLE 1

Preparation of an alcoholic carotenoid fraction

The alcoholic carotenoid fraction is prepared by washing parts of the fresh green tobacco plants (i.e. stems and leaves) for 30 seconds with methylene chloride in an amount of 1 10/kg. of tobacco parts, in order to remove the diterpene rich surface resin. This washing step is then repeated a second time in order to more completely remove the diterpene resin.

The resulting parts of the tobacco plants are homogenized in mwethanol. The homogenized material is centrifuged and kOH solution (KOH content 15%, based on the weight of the fresh tobacco) is added to the centrifugate; the mixture is allowed to stand over night at room temperature, in order to destroy the chlorophyll. A saturated solution of sodium chloride is then added to the solution and the mixture is extracted by shaking with petroleum ether/ether (1:1). The organic phase is evaporated in vacuo at room temperature. The residue is taken up in methanol and the concentration is adjusted to 1–50 g. of solids/l. of methanol.

Photo-oxidation 300 milliliters of an extract obtained as indicated above are introduced into a 500 milliliter reactor and irradiated with a high pressure mercury lamp (Phillips High Pressure Lamp HPK 125) for 10 hours at room temperature while stirring. During this reaction time a continuous stream of synthesis air is allowed to bubble through the solution.

Frctionation

The irradiated extract obtained above is concentrated and introduced into a column filled with silica gel. The column is first eluted with hexane; the eluate, which predominately contains hydrocarbons, is discarded. Elution eith ether is then carried out; this fraction contains, inter alia, valuable lactones, ketones, and aldehydes and is collected. If analysis of the extract shows that it is also rich in free carboxylic acids and ketocarboxylic acids, elution with methanol to which 1% of acetic acid has been added can then also be carried out. The eluates collected are evaporated in vacuo at room temperature, the residue is taken up in ethanol and the solution is then sprayed onto conditioned tobacco.

EXAMPLE 2

The procedure as set out in Example 1 is followed except that about 10 mg of Bengal Rose is added in the photooxidation stage. The reaction batch which has been freed from methanol is subjected to a steam distillation and the distillate is saturated with NaCl and extracted by shaking with diethyl ether. The extract which has been freed from ether is applied to conditioned tobacco.

EXAMPLE 3

A commercially available xanthophyll paste is dissolved in methanol (xanthophyll concentration 1–50 g/l). The irradiation and workup are carried out as in Example 1.

Modifications and variations of the invention will be apparent to those skilled in the art. It is the applicants' intention in the following claims to cover all such equivalent modifications and variations as fall within the true spirit and scope of the invention.

What is claimed is:

1. A process for the preparation of aromatic substances from an alcoholic chlorophyll and carotenoid containing extract from tobacco plant material comprising the steps of:

(a) removing the waxy diterpene components present on the surface of the tobacco plant, (b) Extracting the diterpene free tobacco plant with alcohol;

(c) removing the chlorophyll from said extract, and (d) exposing said extract to a source of ultraviolet light and to a source of oxygen.

2. The process of claim 1 wherein said ultraviolet source is of the wavelength of 220–580 nm.

3. The process of claim 2 wherein the exposure to ultraviolet light is carried out at room temperature.

4. The process of claim 3 wherein the exposure to ultraviolet light is carried out for a period of between about 1 hour and 10 days.

5. The process of claim 4 wherein said exposure to oxygen and ultraviolet light is carried out in the presence of a sensitizer.

6. The process according to claim 4 or claim 5, which comprises fractionating the extract after exposure.

7. A process for the production of aromatic substances from a chlorophyll, diterpene and carotenoid extract comprising the steps of:

(a) removing said chlorophyll from said extract, (b) exposing said extract to a source of ultraviolet light and a source of oxygen.

8. The process of claim 7 wherein said ultraviolet light source is of the wavelength of 220–580 nm.

9. The process of claim 7 wherein the exposure to ultraviolet light is carried out at room temperature.

10. The method of claim 9 wherein the exposure to ultraviolet light is carried out for a period of between about 1 hour and 10 days.

11. The process of claim 10 wherein said exposure to oxygen and ultraviolet light is carried out in the presence of a sensitizer.

12. The process according to claim 10 or claim 11, which comprises fractionating the extract after exposure.

13. A process for the production of aromatic substances which comprises exposing a xanthophyll containing plant extract to a source of ultraviolet light and a source of oxygen and thereby photo-oxidizing the extract to produce aromatic substances.

14. The process of claim 13 wherein said ultraviolet light source is of the wavelength of 220–580 nm.

15. The process of claim 14 wherein the exposure to ultraviolet light is carried out at room temperature.

16. The process of claim 15 wherein the exposure to ultraviolet light is carried out for a period of between about 1 hour and 10 days.

17. The process of claim 16 wherein said exposure to oxygen and ultraviolet light is carried out in the presence of a sensitizer.

18. The process according to claim 16 or claim 17, which comprises fractionating the extract after exposure.

19. The processes of claim 1, 7, or 13 wherein the exposure to ultraviolet light is carried out for a period of between about 6 hours and 24 hours.

20. A method for the production of tobacco with enhanced aromatic properties which comprises applying the product of the processes of claim 1, 7, or 13 to conditioned tobacco.

* * * * *

UNITED STATES PATENT AND TRADEMARK OFFICE

CERTIFICATE OF CORRECTION

PATENT NO. : 4,351,346

DATED : September 28, 1982

INVENTOR(S) : Ursula Brummer, Volker Heeman

It is certified that error appears in the above—identified patent and that said Letters Patent is hereby corrected as shown below:

Column 5, line 3, please cancel "7" and insert --8--.

Signed and Sealed this

*First* Day of *March 1983*

[SEAL]

*Attest:*

GERALD J. MOSSINGHOFF

*Attesting Officer*

*Commissioner of Patents and Trademarks*